United States Patent [19]

Neuroth et al.

[11] Patent Number: 4,567,320

[45] **Date of Patent: * Jan. 28, 1986**

[54] REINFORCED ELECTRICAL CABLE AND METHOD OF FORMING THE CABLE

[75] Inventors: David H. Neuroth, Bethany; Armand Moscovici, Woodbridge, both of Conn.

[73] Assignee: Harvey Hubbell Incorporated, Orange, Conn.

[ * ] Notice: The portion of the term of this patent subsequent to Oct. 11, 2000 has been disclaimed.

[21] Appl. No.: 488,649

[22] Filed: Apr. 26, 1983

[51] Int. Cl.[4] ..... H01B 7/18

[52] U.S. Cl. ..... 174/103; 156/53; 156/56; 174/109; 174/117 F; 174/121 R; 174/121 AR

[58] Field of Search ..... 174/15 C, 102 SP, 103, 174/106 R, 108, 109, 117 F, 121 R, 121 AR, 121 SR; 156/53, 56

[56] References Cited

U.S. PATENT DOCUMENTS

| | | | |
|---|---|---|---|
| 2,544,233 | 3/1951 | Kennedy | 174/117 |
| 2,690,984 | 10/1954 | Crandall et al. | 174/121 |
| 2,930,837 | 3/1960 | Thompson | 174/121 R |
| 3,236,939 | 2/1966 | Blewis et al. | 174/116 |
| 3,299,202 | 1/1967 | Brown | 174/121 R |
| 3,425,865 | 2/1969 | Shelton, Jr. | 174/121 R |
| 3,462,544 | 8/1969 | King | 174/121 |
| 3,602,632 | 8/1971 | Ollis | 174/116 X |
| 3,602,636 | 8/1971 | Evans | 174/115 |
| 3,649,744 | 3/1972 | Coleman | 174/107 |
| 3,684,644 | 8/1972 | Snell | 156/53 |
| 3,742,363 | 6/1973 | Carle | 174/102 R |
| 3,835,929 | 9/1974 | Suman, Jr. | 166/315 |
| 4,096,351 | 6/1978 | Wargin et al. | 174/102 R |
| 4,106,961 | 8/1978 | Kreuger et al. | 174/116 X |
| 4,409,431 | 10/1983 | Neuroth | 174/117 F X |

FOREIGN PATENT DOCUMENTS

| | | | |
|---|---|---|---|
| 22677 | 7/1978 | Japan | 174/121 SR |

OTHER PUBLICATIONS

Hawley, G. G.; Condensed Chemical Dictionary; Tenth Edition; Van Nostrand Reinhold Company; 1981, pp. 902 and 1091.

*Primary Examiner*—R. L. Moses
*Assistant Examiner*—Morris H. Nimmo
*Attorney, Agent, or Firm*—Jerry M. Presson; Alfred N. Goodman

[57] ABSTRACT

A reinforced insulated electrical cable and a method of forming the cable, which is especially useful in oil wells. The reinforcement comprises a thin tape of thermosetting material imbedded with an open-mesh fabric, the tape being spirally wrapped directly around the cable's insulation. The tape is wrapped in unvulcanized form and is then vulcanized in place over the insulation. The layer of open-mesh fabric is spaced from the outer surface of the insulation so that, during vulcanization, the insulation can radially outwardly expand without contacting and thus deforming the fabric, and at the same time the insulation can push part of the thermosetting material through the spaces in the fabric.

20 Claims, 9 Drawing Figures

REINFORCED ELECTRICAL CABLE AND METHOD OF FORMING THE CABLE

FIELD OF THE INVENTION

The invention relates to reinforced insulated electrical cable and the method of forming the cable. The cable is especially useful in oil wells where it is exposed to high pressures. The reinforcement reduces the chances of ruining the cable as it is removed from the well due to explosive decompression of gases trapped in the cable. The reinforcement is provided by a spirally wrapped tape formed of thermosetting material imbedded with an open-mesh fabric.

BACKGROUND OF THE INVENTION

Electrical cables are used extensively in oil wells to power various pumps located many feet below the surface. These cables must be able to survive and perform satisfactorily under extremely adverse conditions of heat, mechanical stress and pressure. In particular, these cables experience down-hole pressures which can be in the hundreds or thousands of pounds per square inch. Typically, the insulation surrounding the conductors in the cable contains micropores into which gas is forced at these high pressures over a period of time. Then, when the cable is rather quickly extracted from the well, there is not sufficient time for the intrapore pressure to bleed off. As a result, the insulation on the cable tends to expand like a balloon and can rupture, rendering the cable useless thereafter.

While there has been much work in this area of protecting down-hole insulated electrical cables to avoid explosive decompression by adding reinforcing layers, there are numerous disadvantages to the prior art. Thus, many of the prior art devices are extremely expensive to manufacture, are bulky and include numerous extra layers of protective material.

Examples of such devices are disclosed in the following U.S. Pat. Nos. 2,544,233 to Kennedy; 2,690,984 to Crandall et al.; 3,462,544 to King; 3,602,636 to Evans; 3,649,744 to Coleman; 3,742,363 to Carle; 3,835,929 to Suman, Jr.; and 4,096,351 to Wargin et al.

SUMMARY OF THE INVENTION

Accordingly, a primary object of the invention is to provide a reinforced electrical cable and method of forming the cable so that the cable can withstand decompressive forces on removing the cable from an oil well.

Another object of the invention is to provide such a cable which is protected from extreme heat, mechanical stress and pressure.

Another object of the invention is to provide such a cable which is cheaper to manufacture and less bulky than the prior art devices and which utilizes merely one layer of reinforcement directly engaging the cable's insulation to resist explosive decompression.

The foregoing objects are basically attained in a method of constructing a reinforced insulated conductor comprising the steps of: forming a thin tape of unvulcanized thermosetting material imbedded with an open-mesh fabric, applying the tape directly over the exterior of the insulated conductor having an outer radius R at ambient temperature to completely cover the exterior thereof with the thermosetting material contacting the insulation, heating the covered conductor for a sufficient period and at a sufficient temperature to allow the outer radius of the insulation to increase to R1 due to thermal expansion thereby pushing the unvulcanized thermosetting material radially outwards so that at least part of it flows through the spaces in the fabric, and maintaining a heated condition until the thermosetting material becomes vulcanized, and cooling the covered conductor, the imbedded fabric as spirally wrapped having a substantially fixed radius R2 that is equal to or greater than the radius R1 of the heated insulation.

The forgoing objects are also attained by providing a reinforced insulated conductor comprising a core of conducting material; a cylindrical insulation layer directly surrounding the core; and a reinforcing layer applied directly around the exterior of the insulation layer to completely cover the exterior, the reinforcing layer comprising a thin tape formed of thermosetting material imbedded with an open-mesh fabric.

Advantageously, the thermosetting material is a vulcanizable rubber and the fabric is formed of glass fibers, e.g., fiber glass mat, or any other type of inorganic or organic fibers, e.g., nylon, polyester, fluorinated polymers, etc., which are relatively non-extensible.

Other objects, advantages and salient features of the invention will become apparent from the following detailed description, which, taken in conjunction with the annexed drawings, discloses a preferred embodiment of the invention.

DRAWINGS

Referring now to the drawings which form a part of this original disclosure;

DETAILED DESCRIPTION OF THE INVENTION

Figure 1:
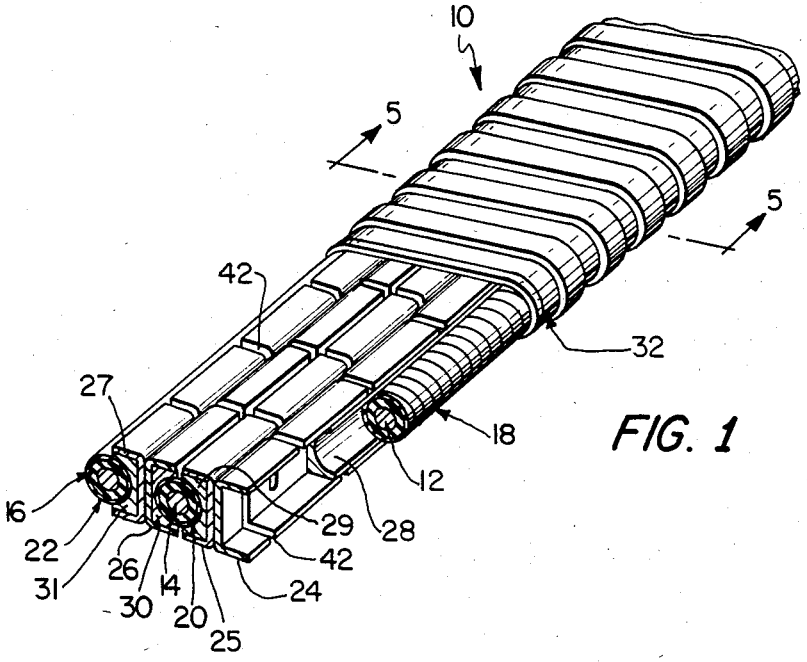
FIG. 1 is a partially cut-away perspective view of the reinforced electrical cable formed in accordance with the invention, this cable comprising three insulated conductors.

Referring now to FIG. 1, the electrical cable 10 in accordance with the invention is shown comprising three insulated electrical conductors 12, 14, and 16, three reinforcement layers 18, 20, and 22 surrounding the conductors, four elongated U-shaped support members 24–27, four liners 28–31 received in the support members, and an exterior armor tape 32 enclosing the entire combination. The cable may also be of the type disclosed in copending U.S. application Ser. No. 291,125, filed Aug. 7, 1981, and assigned to the same assignee as the instant application.

Figure 2:
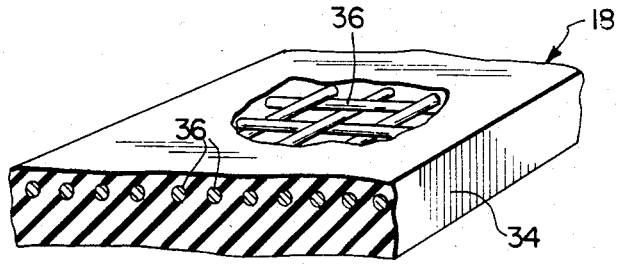
FIG. 2 is an enlarged, fragmentary perspective view of the reinforcement layer formed of thermosetting material imbedded with an open-mesh fabric.
Figure 3:
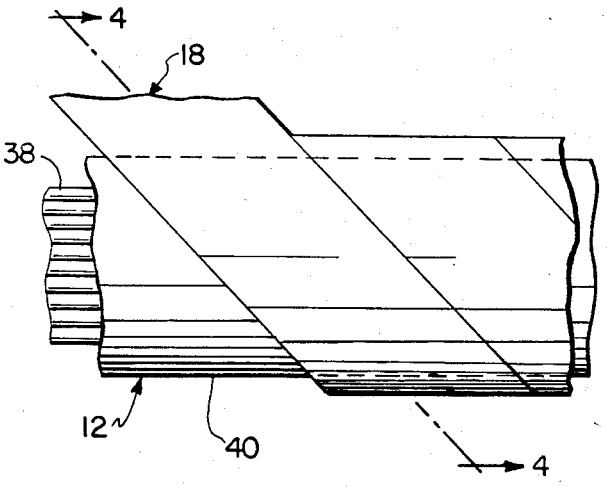
FIG. 3 is an enlarged, side elevational view of an insulated conductor in the process of being butt wrapped with the reinforcement layer shown in FIG. 2.
Figure 4:
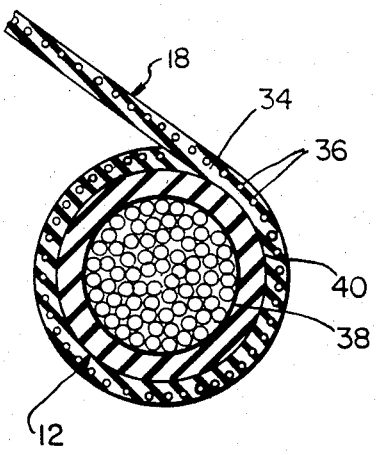
FIG. 4 is an enlarged, left end view in section taken along line 4—4 in FIG. 3 showing the spirally butt wrapped insulated conductor.

As seen in FIGS. 2–4, the reinforcement layer, or tape, 18 is a laminate which is formed as a thin layer of high viscosity thermosetting material 34 embedded by a single layer of a fine open-mesh fabric 36 formed from, for example, woven, braided or knitted nylon or glass fibers that are relatively non-extensible. Advantageously, the thermosetting material has a Mooney viscosity measured at 212° F. of about 50 to about 130 before vulcanization. The tape 18 is formed by applying the thermosetting material to the inner side of the open-mesh fabric to fill some or all of the open spaces therein. A further but thinner layer of the thermosetting material may also be applied on the outer side of the fabric. Thus, as seen in FIG. 2, the fabric in the tape is located closer to the outer side of the tape than the inner side. In all events, the thickness of the inner layer of thermosetting material should be equal to or greater than the radial expansion of the conductor's insulation during vulcanization as discussed hereinafter.

The three insulated conductors 12, 14 and 16 are similarly formed and thus conductor 12 shown in FIG. 4 exemplifies their construction. This construction includes a core 38 formed of conducting material such as metallic strands or a solid metallic wire and an outer cylindrical insulation layer 40 formed, for example, of rubber.

As seen in FIGS. 3 and 4, the reinforcement layer 18 in the form of a thin tape is spirally wrapped directly around the outer surface of the insulation 40 to completely cover that exterior with the thermosetting material being in contact therewith, this spiral wrapping advantageously providing a 5–50% overlap on the previous adjacent spiral laps. This layer is wrapped around the insulated conductor in the unvulcanized form with the fabric 36 forming essentially a cylindrical enclosure around the conductor. Alternatively, the layer can be extruded over the conductor.

Figure 5:
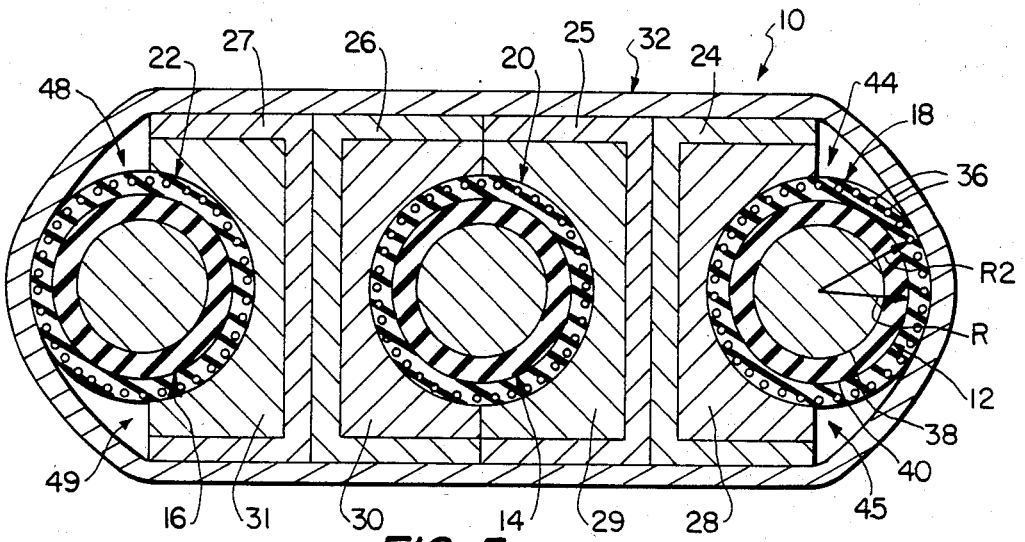
FIG. 5 is an enlarged, left end view in section taken along line 5—5 in FIG. 1 showing three insulated conductors, each spirally wrapped with a reinforcement layer, but before vulcanization of these layers.

As seen in FIG. 5, the radius of the outer surface of the insulation 40 at ambient temperature is designated by R and the radius of the fabric 36 is designated by R2. R2 stays the same during vulcanization while R increases, as will be described in more detail hereinafter. Advantageously, the fabric 36 has a thickness of about 0.005", the thermosetting material 34 has a thickness of about 0.012" before vulcanization and the entire reinforcement layer 18 after vulcanization has a thickness of about 0.013" to 0.015".

As seen in FIGS. 1 and 5, each of the conductors 12, 14 and 16 are first spirally wrapped with the unvulcanized reinforcement layers 18, 20 and 22 and then they are received in the support members and liners forming the cable 10. In particular, each liner is received in one of the U-shaped support members and these members are aligned as seen in FIG. 5 with the conductors and reinforcement layers received in the liners. The liners each have a semi-circular recess to receive the reinforcement layer therein, these liners and the support members being formed of great lengths such as 10,000 feet. To provide flexibility, the support members 24–27 are periodically partially slit as seen in FIG. 1 by means of slits 42 to provide flexibility to the overall cable 10. The liners and support members resist compressive forces acting on the cable.

Advantageously, the liners are formed of lead and the support members are formed of steel, aluminum, fiber-filled carbon compositions or metal-filled curable polymerics.

As seen in FIGS. 1 and 5, the entire combination is enclosed in the armor tape or sheath 32 which is advantageously about 0.020"–0.030" thick and formed of aluminum, steel or bronze.

As seen in FIG. 5, when the armor tape 32 encloses the combination of the support members, liners, reinforcement layers and insulated conductors, various spaces or voids 44, 45, 48 and 49 are formed between the reinforcement layers and the armor tape. Thus, voids 44 and 45 are formed by the outer edges of the support member 24, the outer periphery of reinforcement layer 18 and the inner surface of the armor tape 32. Voids 48 and 49 are similarly formed with regard to reinforcement layer 22 and support member 27. In addition, various voids are formed between the spirally wrapped reinforcement layers and the outer surface of the insulation in each insulated conductor where the spirally wrapped reinforcement layer overlaps itself. Support members 25 and 26 and liners 29 and 30 fit together as seen in FIG. 5 without voids but allow for expansion during heating.

Figure 6:
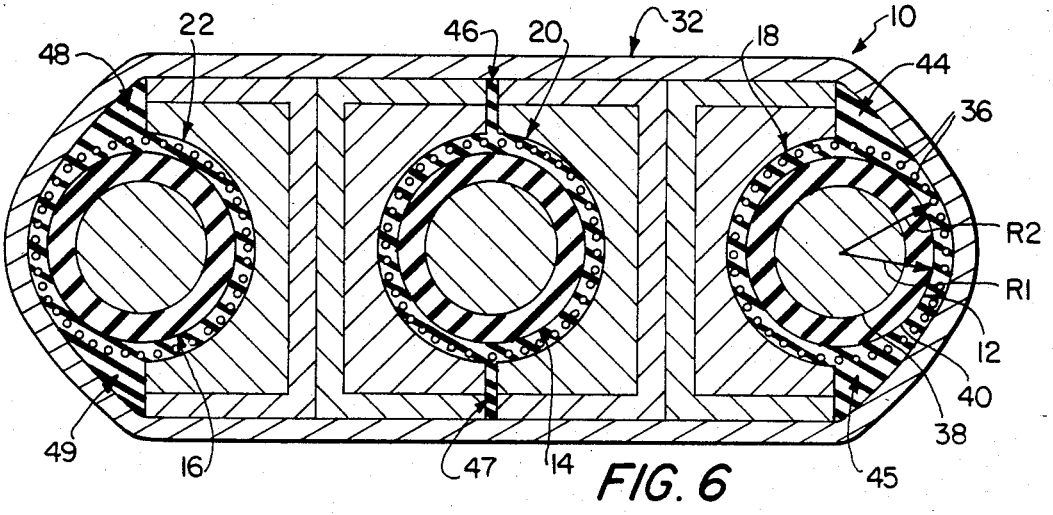
FIG. 6 is an enlarged, left end elevational view similar to that shown in FIG. 5 except that the cable is undergoing heating so as to outwardly radially expand the insulation material and vulcanize the reinforcement layers.
Figure 7:
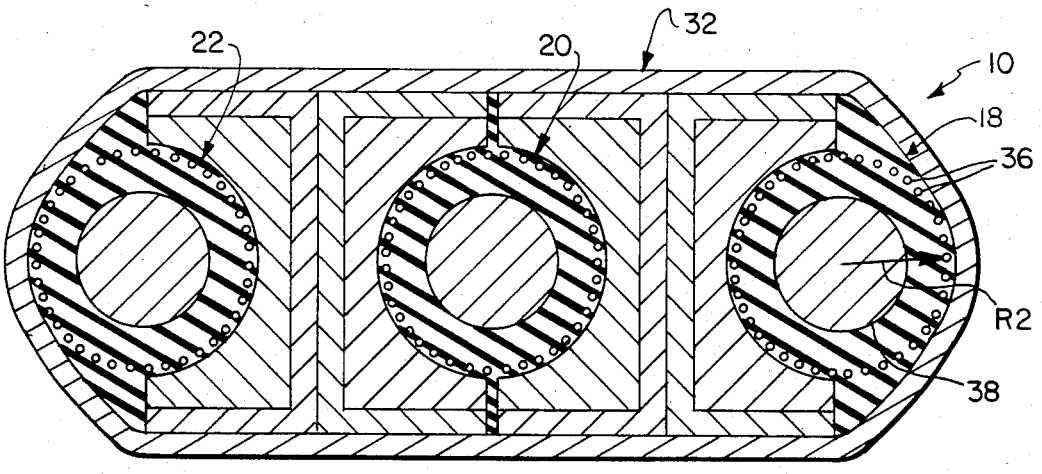
FIG. 7 is an enlarged, left end elevational view similar to that shown in FIG. 6 except that the insulation on the conductors are also vulcanized with the material in the reinforcement layers.

Once the cable 10 is constructed as shown in FIG. 5, the unvulcanized reinforcement layers 18, 20 and 22 are vulcanized. This is accomplished by heating the entire cable 10 to about 300° F. for several hours. During this vulcanization, the insulation of each conductor expands radially outwardly from an outer radius of R as seen in FIG. 5 to a larger radius of R1 as seen in FIG. 6. As this happens, the heated thermosetting material on the inner sides of the reinforcement layers in contact with the insulation is pushed radially outwardly and at least part of it flows through the open spaces in the fabric and beyond to fill the various voids 44, 45, 48 and 49 as well as any other voids between the reinforcement layer and the armor tape and voids 46 and 47 formed by this expansion between liners 29 and 30 and support members 25 and 26. This is shown in FIG. 6 wherein the radius R2 of the fabric remains the same, and is equal to or greater than the radius R1 of the expanded insulation so that the expanded insulation does not engage and rupture the fabric. During vulcanization, pressure is exerted on the thermosetting material as it is forced through the fine open-mesh fabric and also by the enclosure of the armor tape. During this vulcanization process, the insulation can also vulcanize to the thermosetting material as indicated in FIG. 7 if the insulation is of vulcanizable material, which it can be. After a sufficient period of time, the cable 10 is cooled and the overall combination of the insulation and reinforcement layer tends to shrink slightly in the radially inward direction, bringing the fabric into a slightly smaller radius in a slightly wrinkled condition. Advantageously, the cable is used in environments, such as in oil wells, at a temperature of about 300° F., which is substantially the same temperature used for vulcanization. Thus, in use the slightly wrinked condition is eliminated due to expansion of the conductor, thereby optimizing use of the cable.

Thus, the final cable 10 is formed with a reinforcement layer including the open-mesh fabric surrounding the insulated conductor. Accordingly, upon removal of the cable from an oil well, explosive decompression will not occur since the reinforcement layer prevents a rupturing of the insulation.

Figure 8:
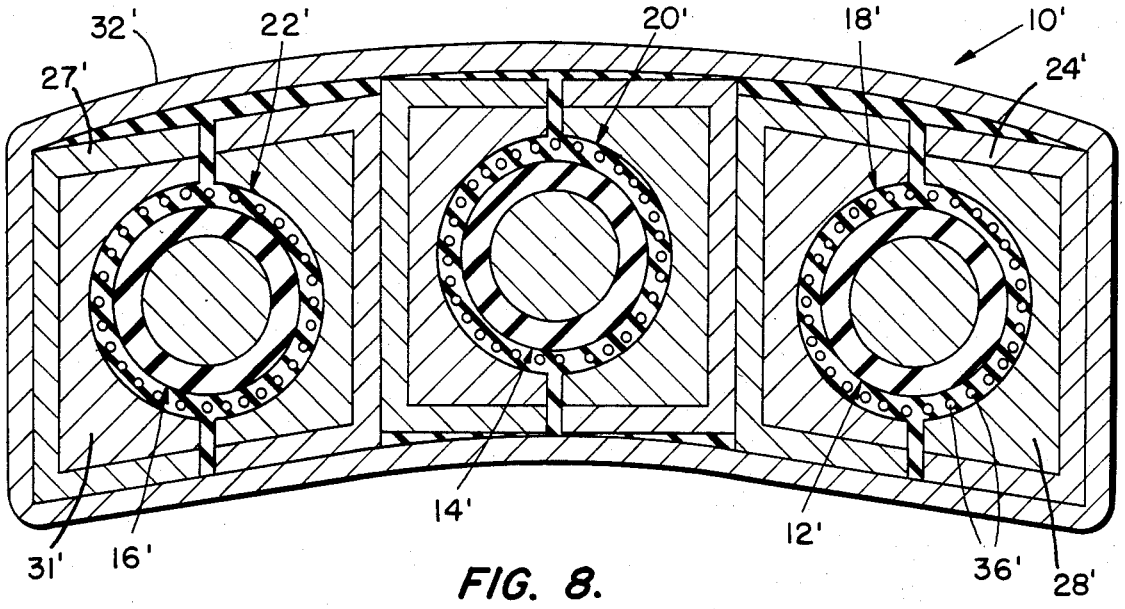
FIG. 8 is a cross sectional view of another embodiment of a cable showing force-resisting members adjacent the side edges of the cable.

FIG. 8 shows a flat cable 10' of slightly arcuate cross section having the outer conductors boxed-in by a pair of force resisting support members 24' and 47' to provide greater edge resistance to impacts. These members 24' and 27' include liners 28' and 31' as discussed above and as disclosed in a copending U.S. application assigned to the same assignee as the instant application.

Figure 9:
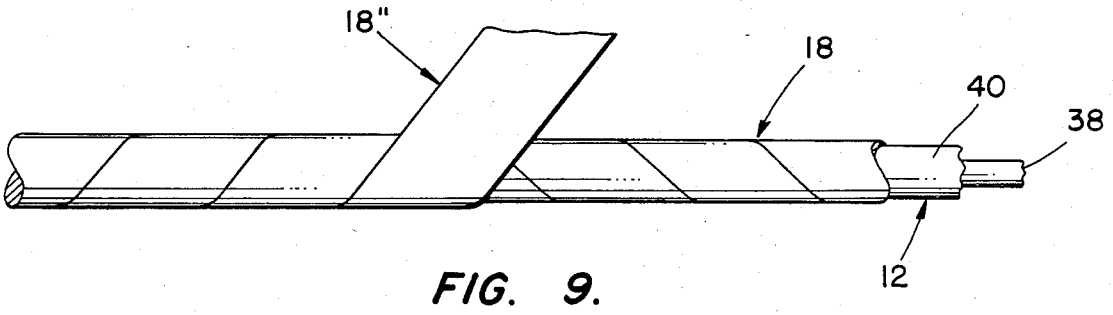
FIG. 9 is an elevational view of a cable in the process of being reverse-wound butt wrapped.

FIG. 9 shows a modified embodiment of the invention wherein conductor 12 is reverse-wound butt wrapped via a first reinforcement layer 18 as well as a second reinforcement layer 18'' in the opposite spiral direction. After the second layer is applied, the heating step discussed above is carried out and the double reinforcement layers provide added protection to the conductor.

While various advantageous embodiments have been chosen to illustrate the invention, it will be understood by those skilled in the art that various changes and modifications can be made therein without departing from the scope of the invention as defined in the appended claims.

What is claimed is:

1. A method of constructing a reinforced insulated conductor comprising the steps of providing a conductor having a core of conducting material and a layer of insulating material surrounding the core, said insulating material being solidified and having an outer radius R at ambient temperatures, forming a thin tape of unvulcanized thermosetting material imbedded with an open-mesh fabric defining a plurality of spaces therein, the inner side of the tape comprising a layer of the unvulcanized thermosetting material, applying the tape directly over the exterior of the solidified layer of insulating material to completely cover the exterior thereof, with the thermosetting material contacting the insulating material, heating the covered conductor for a sufficient period and at a sufficient temperature to allow the outer radius of the solidified insulating material to increase to R1 due to thermal expansion, thereby pushing the unvulcanized thermosetting material radially outwards so that at least part of it flows through the spaces in the open-mesh fabric to the other side thereof and resides there during vulcanization, and maintaining a heated condition until the thermosetting material becomes vulcanized, and cooling the covered conductor, the imbedded fabric as applied having a substantially fixed radius R2 that is equal to or greater than the outer radius R1 of the heated insulation.

2. A method according to claim 1, wherein the thermosetting material is a vulcanizable rubber.

3. A method according to claim 1, wherein the fabric is formed of relatively non-extensible fibers.

4. A method according to claim 1, wherein the thermosetting material has a Mooney viscosity measured at 212° F. of about 50 to about 130 before vulcanization.

5. A method according to claim 1, wherein the heating step is preceded by the step of enclosing the tape in a sheath, and the heating step includes filling any voids between the conductor and the sheath by means of the thermosetting material.

6. A method according to claim 1, wherein the heating step includes vulcanizing the insulation on the conductor to the thermosetting material.

7. A method according to claim 1, wherein the heating step is preceded by the step of applying a second thin tape of unvulcanized thermosetting material embedded with a second open-mesh fabric directly over the exterior of the first tape.

8. A method of constructing a reinforced insulated conductor, comprising the steps of providing a conductor having a core of conducting material and a layer of insulating material surrounding the core, said insulating material being solidified, forming a thin tape of unvulcanized thermosetting material imbedded with an open-mesh fabric, defining a plurality of spaces therein, the inner side thereof comprising a layer of the unvulcanized thermosetting material, applying the tape directly over the exterior of the layer of solidified insulating material to completely cover the exterior thereof, the inner side of the tape contacting the exterior of the layer of insulating material, heating the covered conductor for a sufficient period and at a sufficient temperature to allow the radial thermal expansion of the solidified insulating material to push the unvulcanized thermosetting material radially outwards so that at least part of it flows through the spaces in the open-mesh fabric to the other side thereof and resides there during vulcanization, and maintaining the heated condition until the thermosetting material becomes vulcanized, and cooling the covered conductor, the layer of the unvulcanized thermosetting material as applied having a thickness at least equal to the amount of radial expansion experienced by the solidified insulating material during vulcanization, the imbedded fabric as applied having a substantially fixed radius that is at least equal to the outer radius of the heated solidified insulating material.

9. A method according to claim 8, wherein the applying step comprises spirally wrapping the tape and includes overlapping about 5–50% of each of the previous spiral laps.

10. A method according to claim 8, wherein the forming step comprises applying the thermosetting material to the fabric to fill the spaces therein and applying an additional layer of the thermosetting material on one side thereof.

11. A method according to claim 8, wherein the thermosetting material is a vulcanizable rubber.

12. A method according to claim 8, wherein the fabric is formed of relatively non-extensible fibers.

13. A method according to claim 8, wherein the thermosetting material has a Mooney viscosity measured at 212° F. of about 50 to about 130 before vulcanization.

14. A reinforced insulated conductor formed by the process comprising the steps of providing a conductor having a core of conducting material and a layer of insulating material surrounding the core, said insulating material being solidified, forming a thin tape of unvulcanized thermosetting material imbedded with an open-mesh fabric defining a plurality of spaces therein, the inner side of the tape comprising a layer of the unvulcanized thermosetting material, applying the tape directly over the exterior of the layer of solidified insulating material to completely cover the exterior thereof, the inner side of the tape contacting the exterior of the layer of insulating material, heating the covered conductor for a sufficient period and at a sufficient temperature to allow the radial thermal expansion of the solidified insulating material to push the unvulcanized thermosetting material radially outwards so that at least part of it flows through the spaces in the open-mesh fabric to the other side thereof and resides there during vulcanization, and maintaining a heated condition until the thermosetting material becomes vulcanized, and cooling the covered conductor, the layer of the unvulcanized thermosetting material as applied having a thickness at least equal to the amount of radial expansion experienced by the insulation during vulcanization, the imbedded fabric as applied having a substantially fixed radius that is at least equal to the outer radius of the heated insulation.

15. A reinforced insulated conductor formed by the process according to claim 14, wherein the applying step comprises spirally wrapping the tape and includes overlapping about 5–50% of each of the previous spiral laps.

16. A reinforced insulated conductor formed by the process according to claim 14, wherein the forming step comprises applying the thermosetting material to the open-mesh fabric to fill the spaces therein and applying an additional layer of the thermosetting material on one side thereof.

17. A reinforced insulated conductor formed by the process according to claim 14, wherein the thermosetting material is vulcanizable rubber.

18. A reinforced insulated conductor formed by the process according to claim 14, wherein the fabric is formed of relatively non-extensible fibers.

19. A reinforced insulated conductor formed by the process according to claim 14, wherein the thermosetting material has a Mooney viscosity of about 50 to about 90 before vulcanization.

20. An electrical cable comprising:

a plurality of insulated conductors;

a reinforcing layer applied directly around the exterior of each of said insulated conductors to completely cover said exteriors thereof, said reinforcing layer comprising a thin tape formed of thermosetting material imbedded with an open-mesh fabric;

a force-resisting support member interposed between adjacent ones of said reinforcing layers, said support member being rigid in cross section for resisting transverse compressive forces;

a sheath enclosing said insulated conductors, reinforcing layers and support member; and thermosetting material substantially filling the voids between said sheath and said reinforcing layers and support member.

* * * * *